US012781462B2

(12) United States Patent
Miyabara et al.

(10) Patent No.: US 12,781,462 B2
(45) Date of Patent: Nov. 3, 2026

(54) OPERATION CONTROL SYSTEM OF WORKING VEHICLE WITH ANGLE SENSORS FOR ARM AND BUCKET

(71) Applicant: TAKEUCHI MFG. CO., LTD., Hanishina-gun (JP)

(72) Inventors: Kazuhiro Miyabara, Nagano (JP); Shingo Takeuchi, Nagano (JP); Yutaro Yamazaki, Nagano (JP)

(73) Assignee: TAKEUCHI MFG. CO., LTD. (JP)

( * ) Notice: Subject to any disclaimer, the term of this patent is extended or adjusted under 35 U.S.C. 154(b) by 42 days.

(21) Appl. No.: 18/812,004

(22) Filed: Aug. 22, 2024

(65) Prior Publication Data

US 2025/0137223 A1 May 1, 2025

(30) Foreign Application Priority Data

Oct. 30, 2023 (JP) ..... 2023-185275

(51) Int. Cl.
*E02F 3/43* (2006.01)

(52) U.S. Cl.
CPC ..... *E02F 3/432* (2013.01)

(58) Field of Classification Search
CPC ..... E02F 3/432
See application file for complete search history.

(56) References Cited

FOREIGN PATENT DOCUMENTS

CN 114809148 A * 7/2022 ..... E02F 3/422
JP H11-343631 A 12/1999

* cited by examiner

*Primary Examiner* — Brodie J Follman
(74) *Attorney, Agent, or Firm* — Harness, Dickey & Pierce, P.L.C.

(57) ABSTRACT

An operation control system of a working vehicle capable of maintaining an angle of a bucket at a fixed angle when the bucket is elevated and/or lowered by rotating an arm is provided. The working vehicle includes an arm and a bucket mounted on the arm. The operation control system includes a control unit and a first angle sensor that measures an angle of the bucket. The control unit adjusts an angle of the bucket such that the angle of the bucket takes a fixed angle by referencing the angle of the bucket that the first angle sensor outputs during elevating of the arm and/or during lowering of the arm.

2 Claims, 9 Drawing Sheets

OPERATION CONTROL SYSTEM OF WORKING VEHICLE WITH ANGLE SENSORS FOR ARM AND BUCKET

CROSS REFERENCE TO RELATED APPLICATIONS

This application claims priority to Japanese Patent Application No. 2023-185275, filed on Oct. 30, 2023, which is expressly incorporated herein by reference in its entirety.

BACKGROUND

Technical Field

The present invention relates to an operation control system of a working vehicle.

Related Art

As a working vehicle such as a construction machine, there has been known "crawler loader" (also referred to as "track loader"). The crawler loader includes an arm, and an attachment such as a bucket is configured to be mountable on a distal end of the arm. The crawler loader accommodates soil and sand in the bucket, elevates or lowers the arm thus vertically moving soil and sand accommodated in the bucket in the vertical direction. In such a working vehicle, there may be a case where it is desirable to maintain an angle of the bucket at a fixed angle when the arm is elevated or lowered.

Japanese Laid-open patent publication No. 1999-343631 discloses a working vehicle that has a function of elevating an arm in a state where an angle of a bucket is maintained as it is. FIG. 9 is a view illustrating a working vehicle 901 described in Japanese Laid-open patent publication No. 1999-343631. FIG. 10 is a view for describing a function of elevating the arm while maintaining the angle of the bucket that the working vehicle 901 described in Japanese Laid-open patent publication No. 1999-343631 has.

The working vehicle 901 includes: a bell crank 908 that is rotatably mounted on an approximately center portion of arms 905; a tilt cylinder 907 that connects one end side 908A of the bell crank 908 and the working vehicle 901 to each other; and connecting links 912 (see FIG. 10) that connect the other end side 908B of the bell crank 908 and a back surface of a bucket 911.

One end of the tilt cylinder 907 is rotatably mounted on the working vehicle 901 at a position O below a position at which a proximal portion P of the arm 905 is mounted on the working vehicle 901. A function of maintaining an angle of the bucket 911 means that, as illustrated in FIG. 10, the arm 905 is elevated while maintaining the angle of the bucket 911 at an approximately fixed angle by elevating the arm 905 with the tilt cylinder 907 held in a fixed state.

However, with respect to the function of maintaining the angle of the bucket 911 described in the prior art literature, there is a drawback that, in a case where an angle of elevating the arm 905 is large, the angle of the bucket 911 is displaced in a rollback direction (a direction that a distal end of the bucket 911 is directed upward) at a top position.

The present invention has been made in view of such drawbacks, and it is an object of the present invention to provide an operation control system of a working vehicle capable of maintaining an angle of a bucket at a fixed angle when the bucket is elevated and/or lowered by rotating an arm.

SUMMARY

An operation control system of a working vehicle according to one aspect of the present invention is an operation control system of a working vehicle that includes an arm and a bucket mounted on the arm, wherein the operation control system includes a control unit and a first angle sensor that measures an angle of the bucket. The control unit is configured to adjust an angle of the bucket such that the angle of the bucket takes a fixed angle by referencing the angle of the bucket that the first angle sensor outputs during elevation of the arm and/or during lowering of the arm.

In the operation control system of a working vehicle according to the aspect of this invention, it is preferable that the control unit further includes a second angle sensor that measures an angle made between the working vehicle and a contact ground surface, and the control unit adjusts the angle of the bucket such that an angle made between the working vehicle and the bucket becomes a fixed angle by referencing the angle of the bucket that the first angle sensor outputs and the angle of the working vehicle that the second angle sensor outputs.

In the operation control system of a working vehicle according to the aspect of this invention, it is preferable that the control unit further includes a second angle sensor that measures an angle made between the working vehicle and a contact ground surface, and the control unit adjusts the angle of the bucket such that an angle made between the working vehicle and the bucket maintains a fixed angle by referencing the angle of the bucket that the first angle sensor outputs and the angle of the working vehicle that the second angle sensor outputs during elevation of the arm and/or during lowering of the arm.

An operation control system of a working vehicle according to another aspect of the present invention is an operation control system of a working vehicle that includes an arm and a bucket mounted on the arm, wherein the operation control system includes a control unit, a memory unit, a first angle sensor and a third angle sensor. The first angle sensor measures an angle of the bucket. The third angle sensor measures an angle of the arm. The memory unit stores an angle at a target position of the bucket as the first angle information. The memory unit stores an angle of the arm at the target position as third angle information. The control unit moves the arm such that the angle of the arm becomes a value of the angle stored as the third angle information. The control unit moves the bucket such that the angle of the bucket becomes a value of the angle stored as first angle information.

In the operation control system of a working vehicle according to the aspect of this invention, it is preferable that the angle of the bucket is measured by the first angle sensor and the angle of the arm is measured by the third angle sensor.

An operation control system of a working vehicle according to the present invention is an operation control system of a working vehicle that includes an arm and a bucket mounted on the arm.

The operation control system includes a control unit, a memory unit, and a third angle sensor. The third angle sensor measures an angle of the arm. The memory unit stores the angle of the arm at a stop position at which the arm is stopped as third angle information. The control unit, during the arm is elevated due to an operation of an operator, compares the angle of the arm that the third angle sensor outputs and a value of an angle stored in the memory unit as the third angle information, and in a case where the angle of the arm that the third angle sensor outputs becomes a same value as the value of the angle of the third angle information, the control unit stops an elevating operation of the arm.

In the operation control system of a working vehicle according to the aspect of this invention, it is preferable that the control unit, in a case where a difference between the angle of the arm that the third angle sensor outputs and the value of the angle stored in the memory unit as the third angle information becomes not more than a predetermined angle, sets an elevation speed of the arm to a second speed smaller than a first speed that is an elevation speed up to a point of time that the difference in angle becomes the predetermined angle. [Advantageous effects of Invention]

In the operation control system of a working vehicle, during elevation and/or lowering of the arm, the control unit references the angle of the bucket that the first angle sensor outputs. The control unit is configured to adjust the angle of the bucket such that the angle of the bucket becomes a fixed angle.

According to the operation control system of a working vehicle, it is possible to provide the operation control system of a working vehicle that can maintain the angle of the bucket at a fixed angle when the bucket is elevated and/or lowered by rotating the arm.

DETAILED DESCRIPTION

Hereinafter, a mode for carrying out the present invention (hereinafter, referred to as "embodiment") is described. The embodiment described hereinafter expresses a preferred mode for carrying out the present invention, and is not intend to limit the invention called for in claims. Further, it is not always the case that all of various elements and the combinations of these elements described in the embodiment are in dispensable in present invention.

1. Embodiment 1

1-1 Working Vehicle

Figure 1:
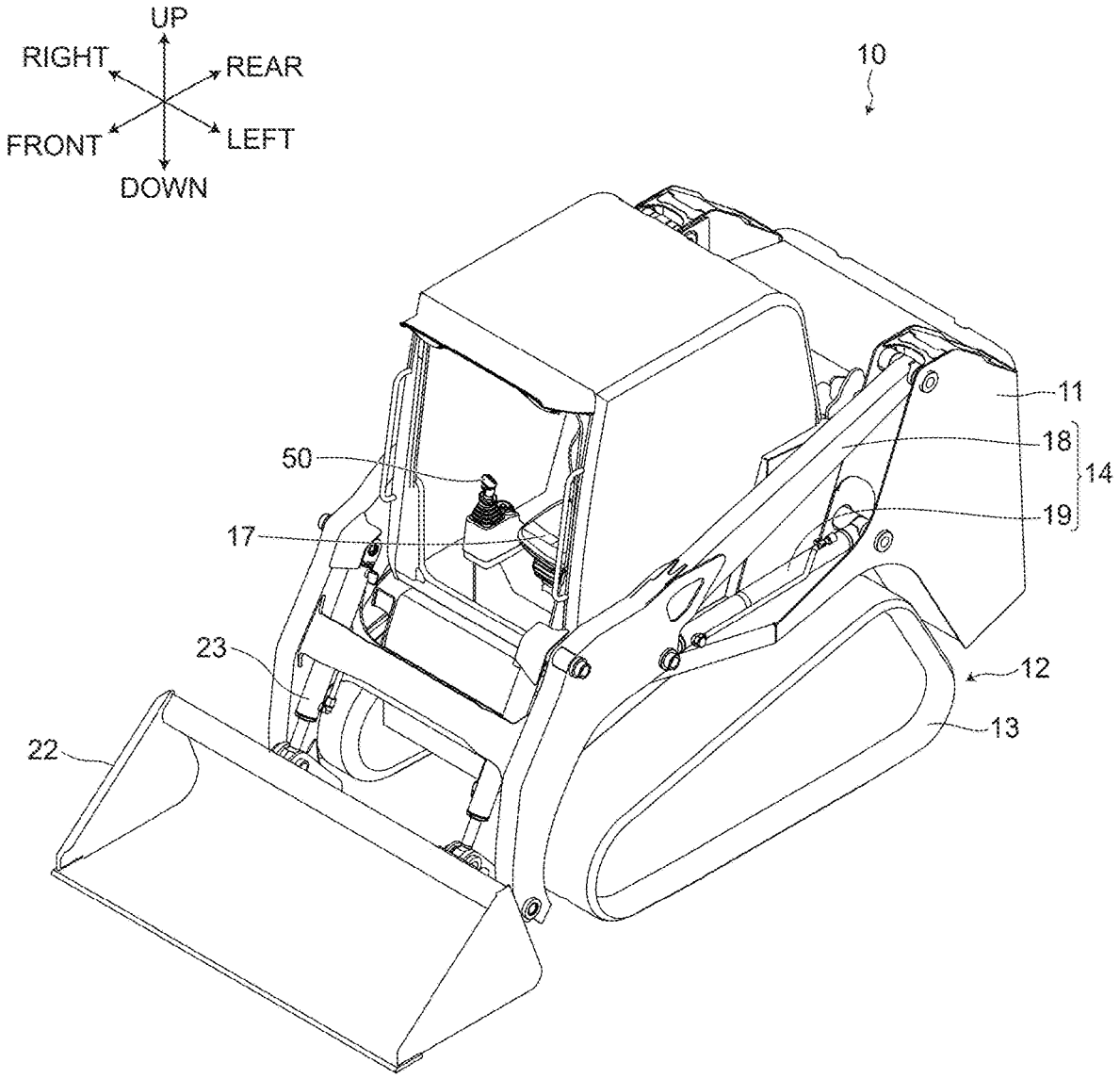
FIG. 1 is a view of a working vehicle 10 on which an operation control system 1 of a working vehicle according to the embodiment 1 is mounted as viewed from an oblique front side.

FIG. 1 is a view of a working vehicle 10 on which an operation control system 1 of a working vehicle according to an embodiment 1 is mounted as viewed from an oblique front side. Hereinafter, the description is made by taking, as the working vehicle 10 that the operation control system 1 of the working vehicle 10 controls, "a crawler loader" (also referred to as "a track loader") that includes an arm 18 and is capable of mounting a bucket 22 on a distal end of the arm 18 as an example.

Further, in the description made hereinafter, as illustrated in FIG. 1, assume a side where the bucket 22 is mounted in the working vehicle 10 as "front", a side opposite to the side where the bucket 22 is mounted as "rear", a side of a bottom surface of the working vehicle 10 as "down", and a side opposite to the bottom surface as "up", a side of a left side surface of the working vehicle 10 as viewed from behind the working vehicle 10 as "left", and a side of a right side surface of the working vehicle 10 as viewed from behind the working vehicle 10 as "right".

Further, in the present specification, the "angle" does not necessarily have an absolute meaning such as an angle with respect to a horizontal plane. The angle may be an angle with respect to an arbitrary reference.

As illustrated in FIG. 1, the working vehicle 10 includes: a body frame 11; a pair of left and right travelling devices 12 that is mounted on the body frame 11 and have crawlers (endless tracks) 13; a working device 14 that is mounted on a body device; and a cabin (symbol being omitted) that is mounted on a center upper portion of the body frame 11.

An operator seat 17 on which an operator is seated facing a front side of a vehicle is provided to the cabin. Remote control levers 50 are respectively arranged on left and right sides of the operator seat 17.

In the working vehicle 10, the operator seated on the operator seat 17 can elevate or lower the arm 18, and can change an angle of the bucket 22 by operating the remote control levers 50.

For example, the working vehicle 10 is configured such that when the operator elevates the arm 18 by tilting the remote control lever 50 disposed on the right side of the operator seat 17 rearward, and lowers the arm 18 by tilting the remote control lever 50 frontward. Further, the working vehicle 10 is configured such that the bucket 22 is rotated in the direction that the bucket 22 is tilted backward by tilting the remote control lever 50 leftward, and the bucket 22 is rotated in the direction that the bucket 22 is dumped by tilting the remote control lever 50 rightward.

The working device 14 includes: the arm 18 that is rotatably mounted on the body frame 11; an arm cylinder 19; the bucket 22 that is mounted on a distal end of the arm 18; and a bucket cylinder 23.

The arm cylinder 19 is mounted in an extending manner between the body frame 11 and the arm 18. By extending or retracting the arm cylinder 19, the arm 18 is rotated so that an angle of the arm 18 can be changed. The bucket cylinder 23 is mounted in an extending manner between the arm 18 and the bucket 22. By extending or retracting the bucket cylinder 23, an angle of the bucket 22 can be changed.

Figure 2:
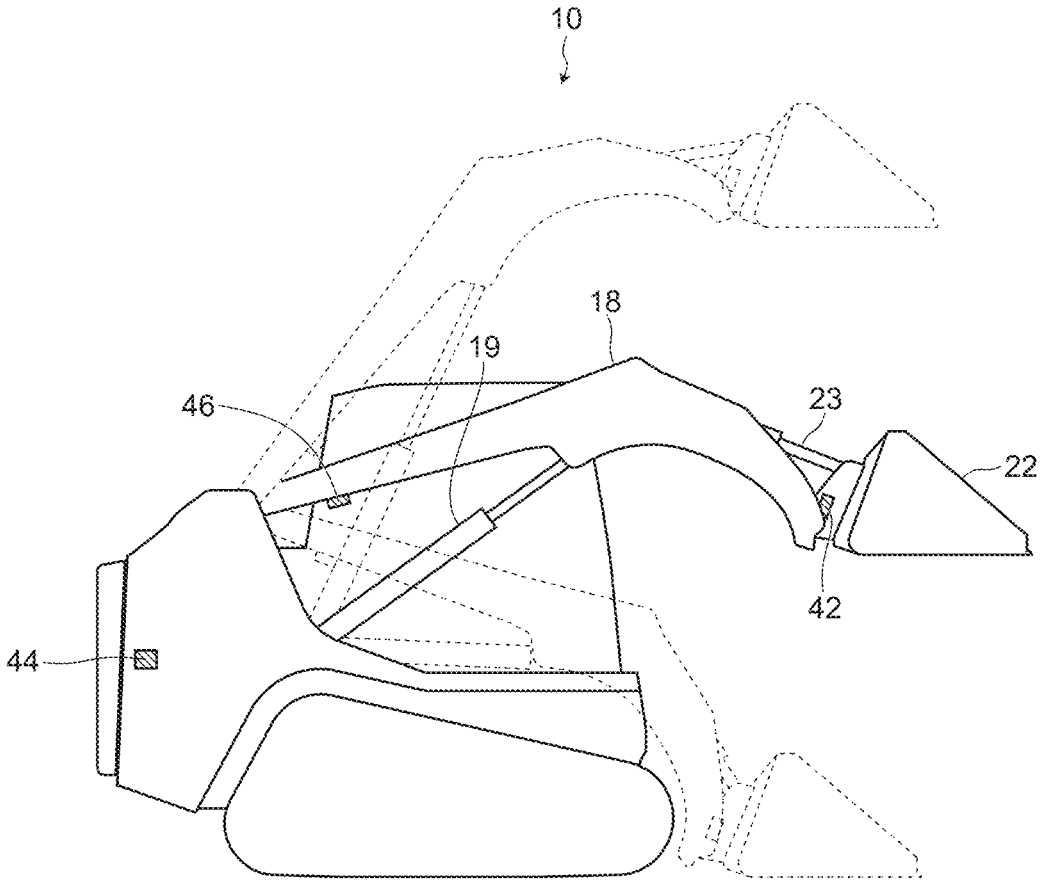
FIG. 2 is a view for describing the movements of an arm 18 and a bucket 22 in the operation control system 1 of a working vehicle according to the embodiment 1.

As illustrated in FIG. 2, the working vehicle 10 has a first angle sensor 42, a second angle sensor 44, and a third angle sensor 46.

The first angle sensor 42 is mounted on the bucket 22. The first angle sensor 42 measures an angle of the bucket 22. The second angle sensor 44 is mounted on the at a suitable position of the body frame 11 of the working vehicle 10, for example, a rear portion of a side surface of the body frame 11. The second angle sensor 44 measures an angle made between the working vehicle 10 and a ground surface. The third angle sensor 46 is disposed on the arm 18. The third angle sensor 46 measures an angle of the arm 18.

With respect to the first angle sensor 42, the second angle sensor 44 and the third angle sensor 46, a kind, a name, and a measuring method of the angle sensor is not limited so long as it is possible to measure an angle of a place on which the angle sensor is disposed, for example, an angle of the bucket 22 in case of the first angle sensor 42. Various sensors such as a gyro sensor and an inertial sensor can be used. Also with respect to the measuring method, sensors of various methods such as an electrostatic capacitance method and a piezoelectric method can be used.

1-2. Operation Control System of Working Vehicle

Next, the operation control system 1 of the working vehicle 10 is described. The operation control system 1 of the working vehicle 10 is a system that controls the bucket 22 such that the angle of the bucket 22 mounted on the distal end of the arm 18 is set to a fixed angle when the arm 18 is elevated or lowered (hereinafter, also referred to as "self-level Up & Down control system").

Figure 3:
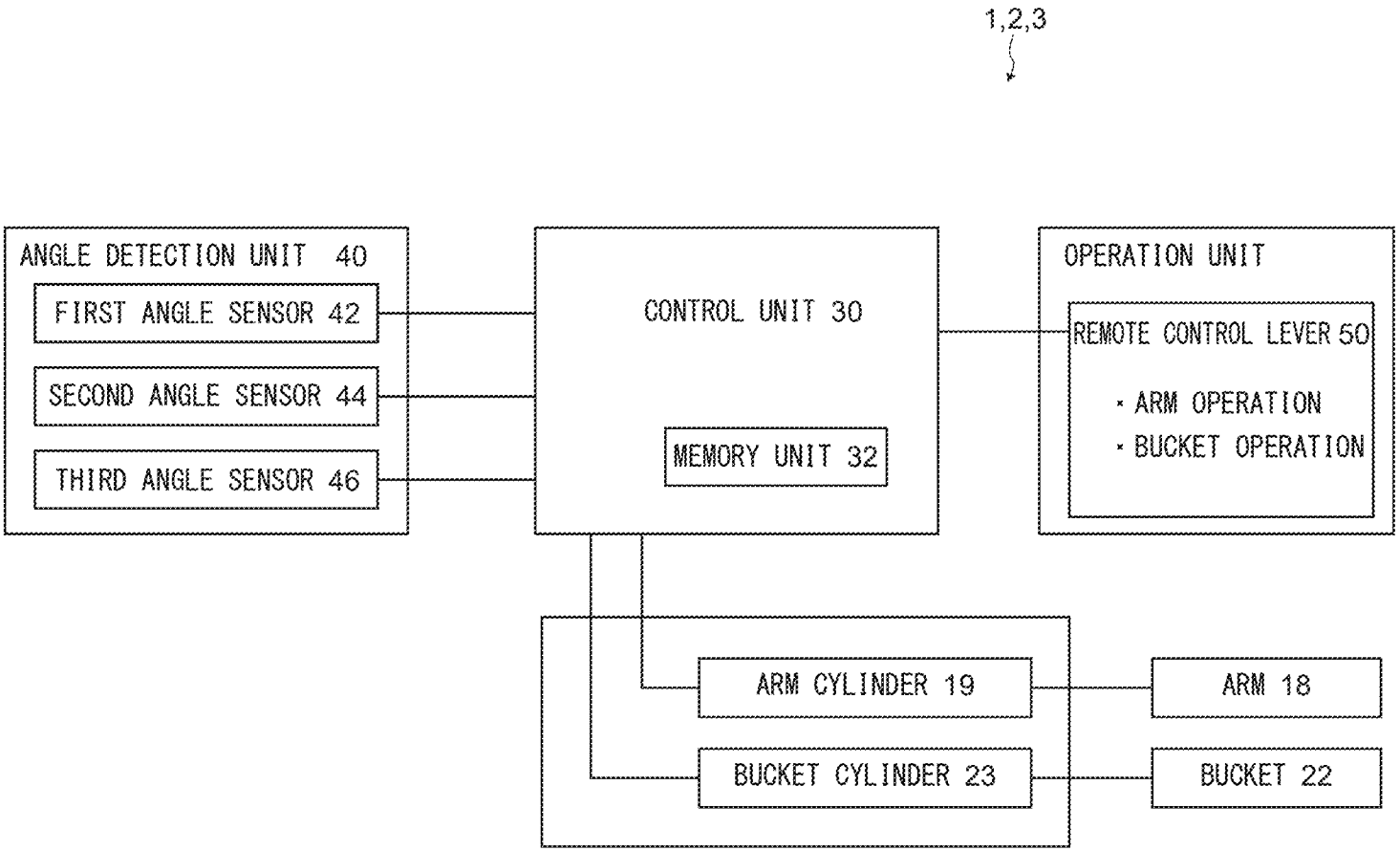
FIG. 3 is a block diagram illustrating the configuration of the operation control system 1 of a working vehicle according to the embodiment 1.
Figure 4:
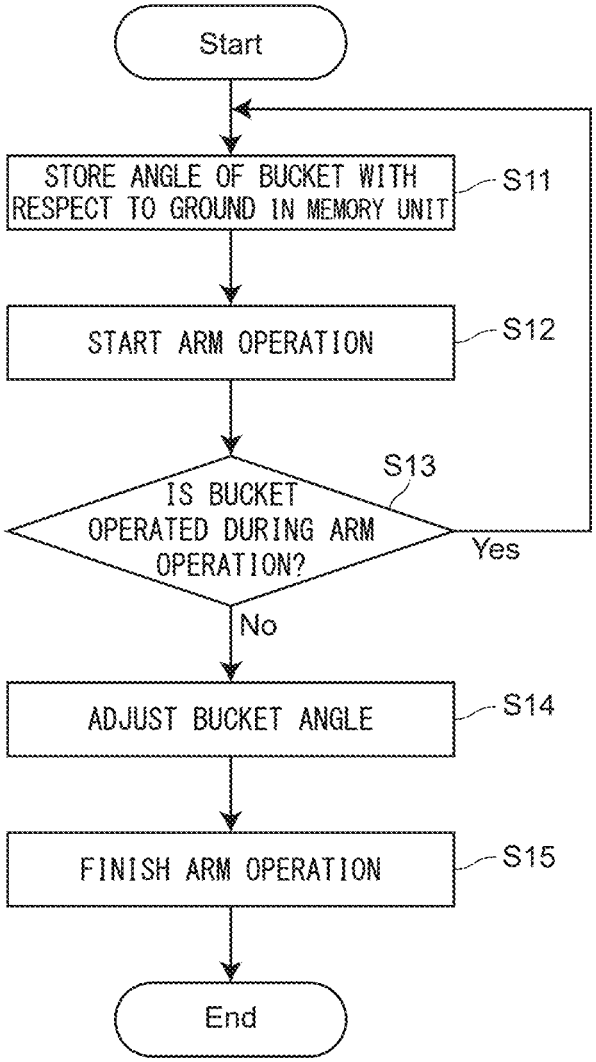
FIG. 4 is a flowchart for describing processing performed by the operation control system 1 of a working vehicle according to the embodiment 1.

FIG. 2 is a view for describing the movement of the arm 18 and the bucket 22 in the operation control system 1 of the working vehicle 10 according to the embodiment 1. FIG. 3 is a block diagram illustrating the configuration of the operation control system 1 of the working vehicle 10 according to the embodiment 1. FIG. 4 is a flowchart for describing processing performed by the operation control system 1 of the working vehicle 10 according to the embodiment 1.

As illustrated in FIG. 3, the self-level Up & Down control system includes a control unit 30, an angle detection unit 40, and an operation unit. The control unit 30 includes a memory unit 32. The angle detection unit 40 includes the first angle sensor 42, the second angle sensor 44, and the third angle sensor 46. The operation unit includes the remote control lever 50.

An angle control of the bucket 22 in the self-level Up & Down control system is described with reference to FIG. 2 and FIG. 4.

In the operation control system 1 of the working vehicle 10, the control unit 30 references an angle of the bucket 22 that the first angle sensor 42 outputs during elevation and/or lowering of the arm 18, and adjusts an angle of the bucket 22 such that the angle of the bucket 22 becomes a fixed angle.

The step S11 (see FIG. 4) is a step where the control unit 30 acquires the angle of the bucket 22 and stores the angle in the memory unit 32. The control unit 30 acquires the angle of the bucket 22 at a point of time that an operator (not indicated by symbol) stops an operation of the bucket 22 after operating the bucket 22. The first angle sensor 42 disposed on the bucket 22 measures the angle of the bucket 22. The angle of the bucket 22 is stored as first angle information in the memory unit 32.

In the description made hereinafter, for the sake of convenience of the description, with respect to a rotational direction of the bucket 22, "the direction that the bucket 22 is tilted backward" may be described as "the direction that the angle of the bucket 22 is increased", and "the direction that the bucket 22 is dumped" may be described as "the direction that the angle of the bucket 22 is decreased".

In step S12, the operator operates the arm 18. The arm 18 may be elevated or lowered by the operation of the arm 18 by the operator (see FIG. 2). The operation of the arm 18 is performed such that the operator operates the remote control lever 50 so as to extend or retract the arm cylinder 19.

In a case where the bucket 22 is operated by the operator during the operation of the arm 18 by the operator ("Yes" in step S13), the control unit 30 acquires the angle of the bucket 22 at a point of time that the operator stops the operation of the bucket 22. Further, the acquired angle of the bucket 22 is stored in the memory unit 32 by the control unit 30 (see S 11).

In a case where the bucket 22 is not operated by the operator during the operation of the arm 18 by the operator ("No" in step S13), the control unit 30 adjust the angle of the bucket 22 while continuing the operation of the arm 18 (elevating or lowering of the arm 18). The control unit 30 adjusts the angle of the bucket 22 such that the angle of the bucket 22 becomes a fixed angle by referencing the angle of the bucket 22 that the first angle sensor 42 outputs (see S14).

To be more specific, the control unit 30 adjusts the amount of pressurized oil that is supplied to the bucket cylinder 23 such that the angle of the bucket 22 that the first angle sensor 42 outputs approaches a value of an angle of the first angle information stored in the memory unit 32. Accordingly, the angle of the bucket 22 during the operation of the arm 18 can be maintained at a fixed angle.

The control unit 30 may adjust the angle of the bucket 22 such that an angle made by the working vehicle 10 and the bucket 22 becomes a fixed angle by referencing the angle of the bucket 22 that the first angle sensor 42 outputs and the angle of the working vehicle 10 that the second angle sensor 44 disposed on the working vehicle 10 outputs. With such processing, even in a case where the working vehicle 10 performs operation on an inclined ground, the control unit 30 can elevate or lower the arm 18 while maintaining the angle of the bucket 22 at a fixed angle.

The operator finishes the operation of the arm 18 when the arm 18 reaches a predetermined height (see S15).

In the operation control system 1 of the working vehicle 10 according to the embodiment 1 (self-level Up & Down control system), the angle of the bucket 22, that is, a length of the bucket cylinder 23 is adjusted such that the angle of the bucket 22 becomes a fixed angle by referencing the angle of the bucket 22 that the first angle sensor 42 outputs. Accordingly, it is possible to provide the operation control system 1 of the working vehicle 10 where, when the bucket 22 is elevated and/or lowered by rotating the arm 18, the angle of the bucket 22 can be maintained at a fixed angle.

In a preferred mode of the operation control system 1 of the working vehicle 10 according to the embodiment 1 (self-level Up & Down control system), the angle of the bucket 22 is adjusted such that the angle made by the working vehicle 10 and the bucket 22 becomes a fixed angle or maintains a fixed angle by referencing the angle of the bucket 22 that the first angle sensor 42 outputs and the angle of the working vehicle 10 that the second angle sensor 44 disposed on the working vehicle 10 outputs during elevation of the arm 18 and/or during lowering of the arm 18. Accordingly, in addition to the above-mentioned effect, even in a case where the working vehicle 10 performs working on an inclined ground with the work vehicle 10 moving, the arm 18 can be elevated or lowered while maintaining the angle of the bucket 22 at a fixed angle.

2. Embodiment 2

Next, an operation control system 2 of a working vehicle according to the embodiment 2 is described. The operation control system 2 of the working vehicle 10 is a system where the control unit 30 performs a control of moving the positions of the arm 18 and the bucket 22 to target positions stored in a memory unit 32 (hereinafter, also described as "return-to-position control system").

In the operation control system 2 of the working vehicle 10, the working vehicle 10 on which the operation control system 2 is mounted and components that constitute the operation control system 2 are equal to the corresponding working vehicle 10 and the corresponding components of the operation control system 1 of the working vehicle 10 according to the embodiment 1.

Accordingly, in the description of the operation control system 2 of the working vehicle 10, the description of the components of the operation control system 2 of the working vehicle 10 according to the embodiment 2 that are substantially identical with the corresponding components of the operation control system 1 of the working vehicle 10 according to the embodiment 1 is omitted, and the description is made only with respect to the components by which the operation control system 2 differs from the operation control system 1.

Figure 5:
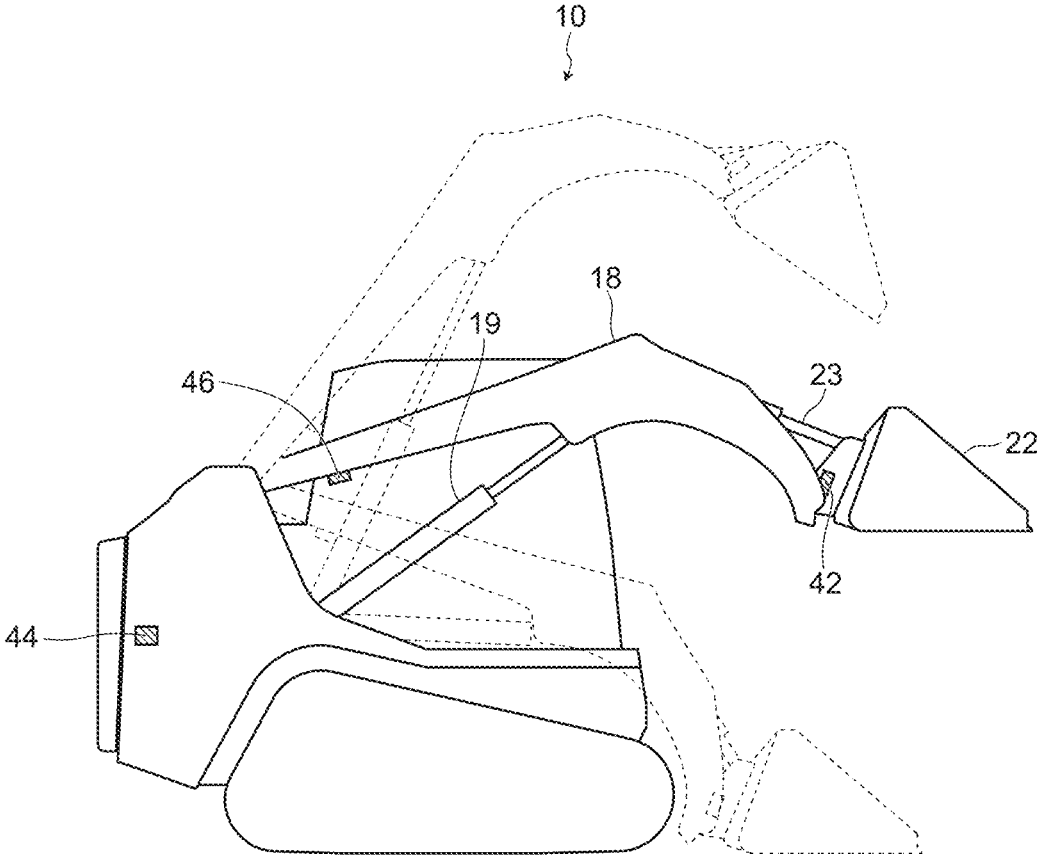
FIG. 5 is a view for describing the movements of an arm 18 and a bucket 22 in an operation control system 2 of a working vehicle according to an embodiment 2.
Figure 6:
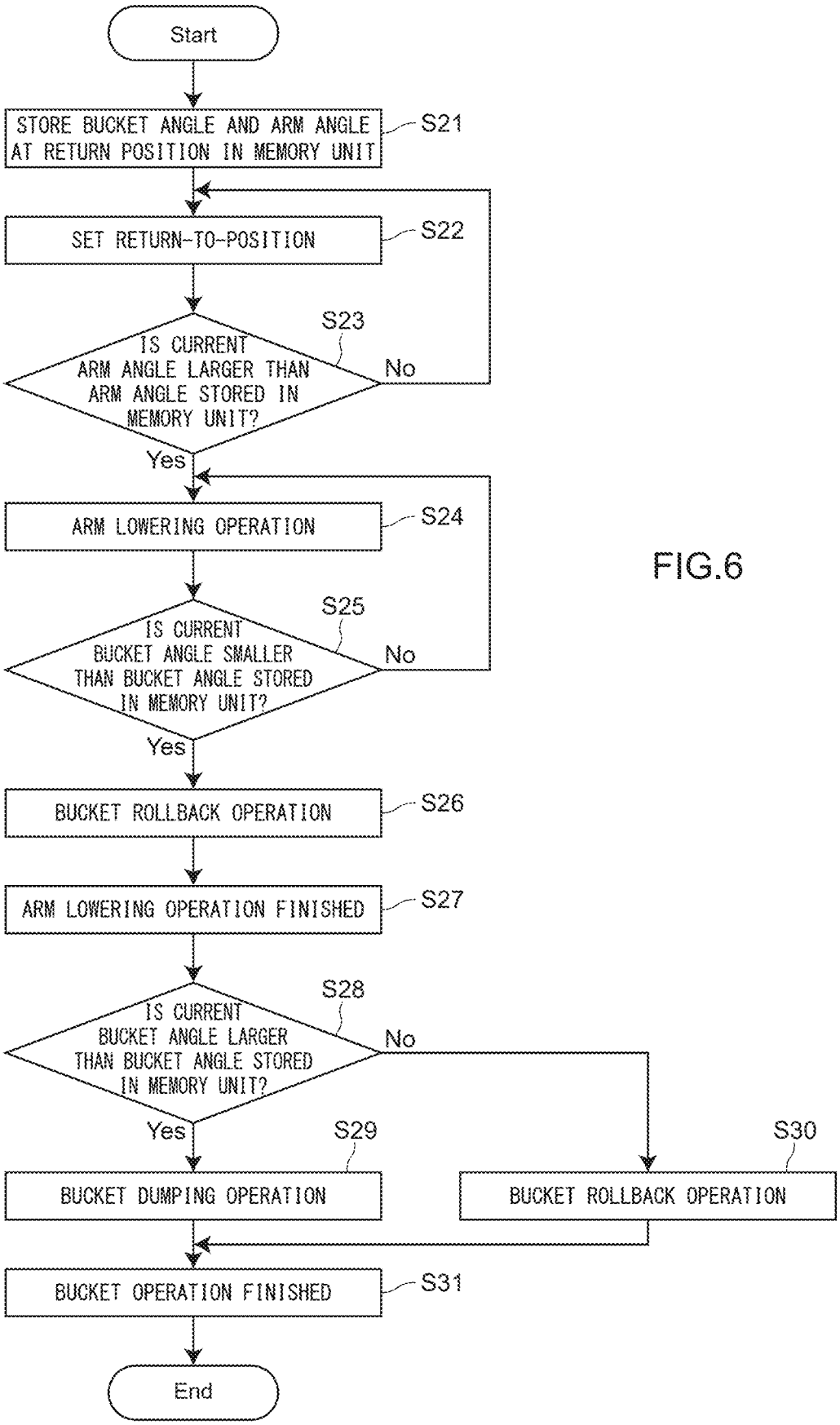
FIG. 6 is a flowchart for describing processing performed by the operation control system 2 of a working vehicle according to the embodiment 2.

FIG. 5 is a view for describing the movements of the arm 18 and the bucket 22 in the operation control system 2 of the working vehicle 10 according to the embodiment 2. FIG. 6 is a flowchart illustrating processing in the operation control system 2 of the working vehicle 10 according to the embodiment 2.

Hereinafter, a control of the arm 18 and the bucket 22 in the return-to-position control system is described with reference to FIG. 5 and FIG. 6.

In the operation control system 2 of the working vehicle 10, the memory unit 32 stores an angle of the bucket 22 at the target position as first angle information, and stores an angle of the arm 18 at the target position as third angle information. The control unit 30 moves the arm 18 such that the angle of the arm 18 becomes a value of the angle stored as the third angle information, and moves the bucket 22 such that the angle of the bucket 22 becomes a value of the angle stored as the first angle information.

In step S21, the angle of the arm 18 and the angle of the bucket 22 at the return position are stored in the memory unit 32 (see FIG. 3). In such processing, the return position means a target position that the arm 18 and the bucket 22 reach as a result of the moving controlled by the control unit 30 (hereinafter also referred to as "automatic moving"). For example, in FIG. 5, out of two positions of the arm 18 and the bucket 22 depicted by a dotted line, the return position is the position of the arm 18 and the bucket 22 indicated on a lower side.

As a method of storing the angle of the arm 18 and the angle of the bucket 22 at the return position, the following method can be exemplified. That is, an operator operates the arm 18 and the bucket 22 so as to move the arm 18 and the bucket 22 to the return position. Then, the control unit 30 acquires the angle of the arm 18 by a third angle sensor 46, acquires the angle of the bucket 22 by a first angle sensor 42, and stores these angles in the memory unit 32.

The control unit 30 makes the memory unit 32 store the angle of the arm 18 at the return position in the memory unit 32 as third angle information, store the angle of the bucket 22 at the return position in the memory unit 32 as first angle information, and, starts the "return-to-position" mode (see S22). As a method for starting the "return-to-position" mode for example, a method where an operator pushes one or plurality of buttons mounted on a remote control lever 50 and the like can be used.

In step S23, the control unit 30 compares the current angle of the arm 18 and the value of the angle stored in the memory unit 32 as the third angle information to each other. In a case where the current angle of the arm 18 is equal to the value of the angle stored in the memory unit 32 as the third angle information or is smaller than the value of the angle stored in the memory unit 32 as the third angle information ("No" in step S23), the "return-to-position" mode is reset, and the processing unit stands by until the "return-to-position" mode is started again.

In a case where, the current angle of the arm 18 is larger than the value of the angle stored in the memory unit 32 as the third angle information ("Yes" in step S23), the control unit 30 performs a lowering operation of the arm 18 (see step S24).

In step S25, the control unit 30 compares the current angle of the bucket 22 and the value of the angle stored in the memory unit 32 as the first angle information to each other. In a case where the current angle of the bucket 22 is equal to the value of the angle stored in the memory unit 32 as the first angle information or is larger than the value of the angle stored in the memory unit 32 as the first angle information ("No" in step S25), the processing returns to step S24 and the lowering operation of the arm 18 is continued.

In a case where the current angle of the bucket 22 is smaller than the value of the angle stored as the first angle information in the memory unit 32 ("Yes" in step S25), the control unit 30 performs a rollback operation of the bucket 22 in parallel to a lowering operation of the arm 18. The rollback operation of the bucket 22 is an operation of rotating the bucket 22 in a direction that the bucket 22 is tilted backward.

Accordingly, even in a case where the bucket 22 is directed in a dumping direction (a distal end of the bucket 22 is descending in a downward direction from a horizontal plane) at the initial position, when the arm 18 is lowered, it is possible to prevent the distal end of the bucket 22 from being brought into contact with a ground. Further, when the distal end of the bucket 22 is directed downward along with the lowering operation of the arm 18, it is possible to prevent falling of soil and sand accommodated in the bucket 22 from the bucket 22.

In step S27, in a case where the angle of the arm 18 becomes equal to the value of the angle stored in the memory unit 32 as the third angle information, the lowering operation of the arm 18 is completed.

In step S28, the control unit 30 compares the current angle of the bucket 22 and the value of the angle stored in the memory unit 32 as the first angle information to each other.

In a case where the current angle of the bucket 22 is larger than a value of an angle stored in the memory unit 32 as the first angle information ("Yes" in step S28), the processing advances to S29 where a dumping operation of the bucket 22 is performed. The dumping operation of the bucket 22 means an operation of rotating the bucket 22 in the dumping direction.

A dumping operation of the bucket 22 is performed by referencing an angle of the bucket 22 that the first angle sensor 42 outputs. When the angle of the bucket 22 agrees with the value of the angle stored in the memory unit 32 as the first angle information, the dumping operation of the bucket 22 is finished.

In a case where the current angle of the bucket 22 is smaller than the value of the angle stored in the memory unit 32 as the first angle information ("No" in step S28), the processing advances to step S30, and the control unit 30 performs a rollback operation of the bucket 22. The rollback operation of the bucket 22 is an operation of rotating the bucket 22 in the rollback direction as described above.

The rollback operation of the bucket 22 is performed by referencing the angle of the bucket 22 that the first angle sensor 42 outputs. When the angle of the bucket 22 agrees with the value of the angle stored in the memory unit 32 as the first angle information, the rollback operation of the bucket 22 is finished.

By performing the dumping operation of the bucket 22 or the rollback operation of the bucket 22, the angle of the bucket 22 can be adjusted to the angle of the bucket 22 at the return position (target position).

Then, the processing advances to step S31, and the operation of the bucket 22 is finished.

In the operation control system 2 (return-to-position control system) of the working vehicle 10, the control unit 30 moves the arm 18 such that the angle of the arm 18 becomes the value of the angle stored in the memory unit 32 as the third angle information. Further, the control unit 30 moves the bucket 22 such that the angle of the bucket 22 becomes the value of the angle stored in the memory unit 32 as the first angle information.

With such a processing, the control unit 30 can move the arm 18 and the bucket 22 to a return position (target position).

3. Embodiment 3

Hereinafter, an operation control system 3 of a working vehicle according to the embodiment 3 is described. The operation control system 3 of the working vehicle 10 is a system that performs a control of preventing the elevation of arm 18 to a position higher than a predetermined height (hereinafter, also referred to as "arm height limit control system").

In the operation control system 3 of the working vehicle 10, the working vehicle 10 on which the operation control system 3 is mounted and the operation control system 3 have the same constitutional elements as the operation control system 1 according to the embodiment 1.

Accordingly, in the description of the operation control system 3 of the working vehicle 10, the description of the components of the operation control system 3 of the working vehicle 10 according to the embodiment 3 that are substantially identical with the corresponding components of the operation control system 1 of the working vehicle 10 according to the embodiment 1 is omitted, and the description is made only with respect to the components by which the operation control system 3 is made different from the operation control system 1.

Figure 7:
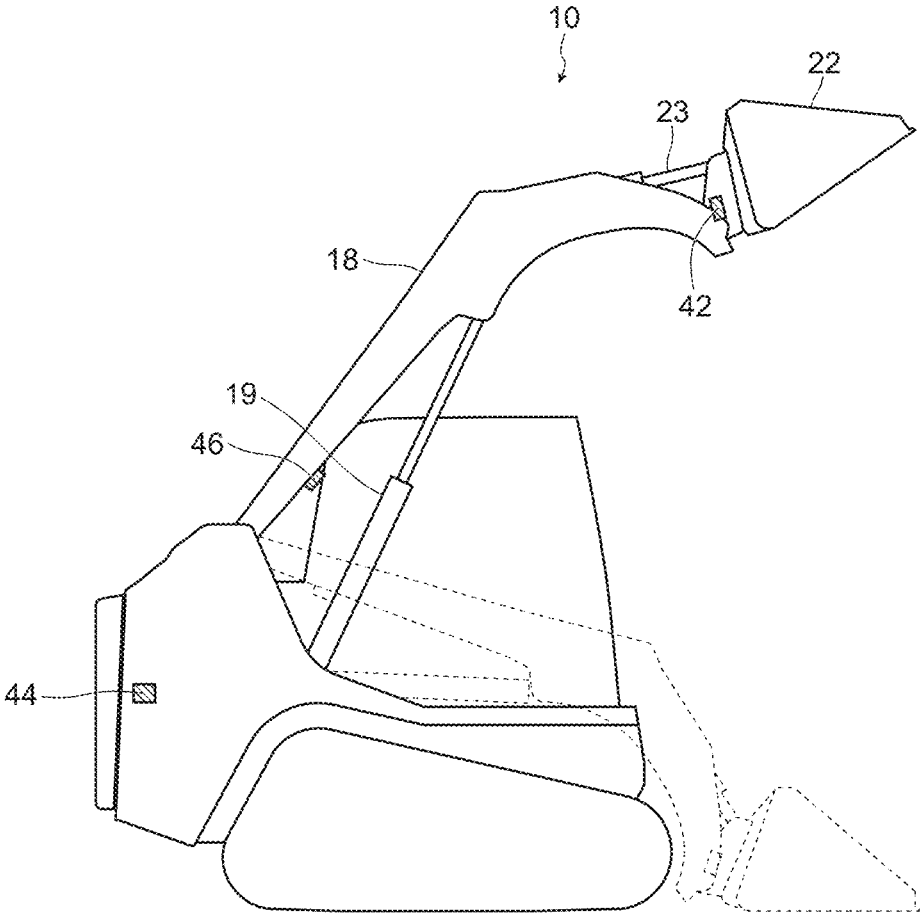
FIG. 7 is a view for describing the movements of an arm 18 and a bucket 22 in an operation control system 3 of a working vehicle according to an embodiment 3.
Figure 8:
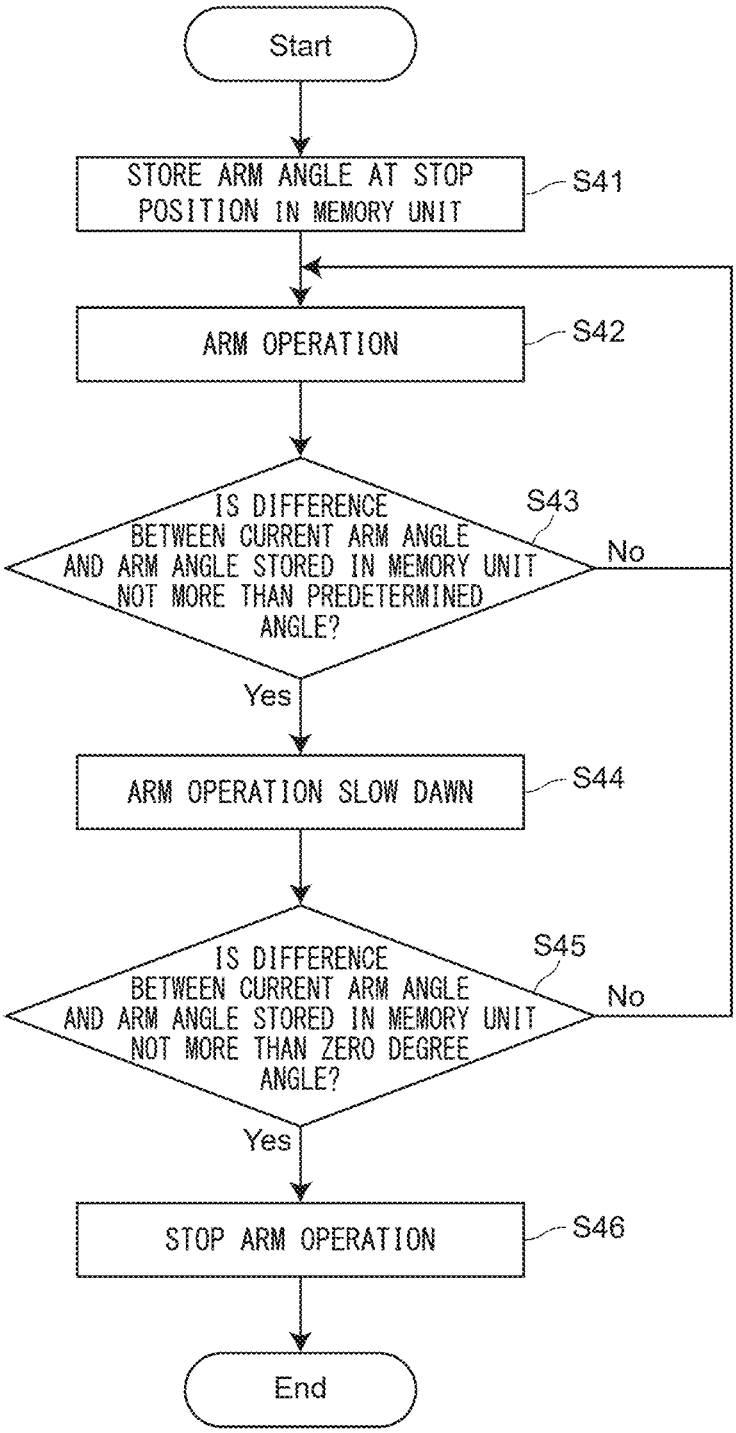
FIG. 8 is a flowchart for describing processing performed by the operation control system 3 of a working vehicle according the embodiment 3.
Figure 9:
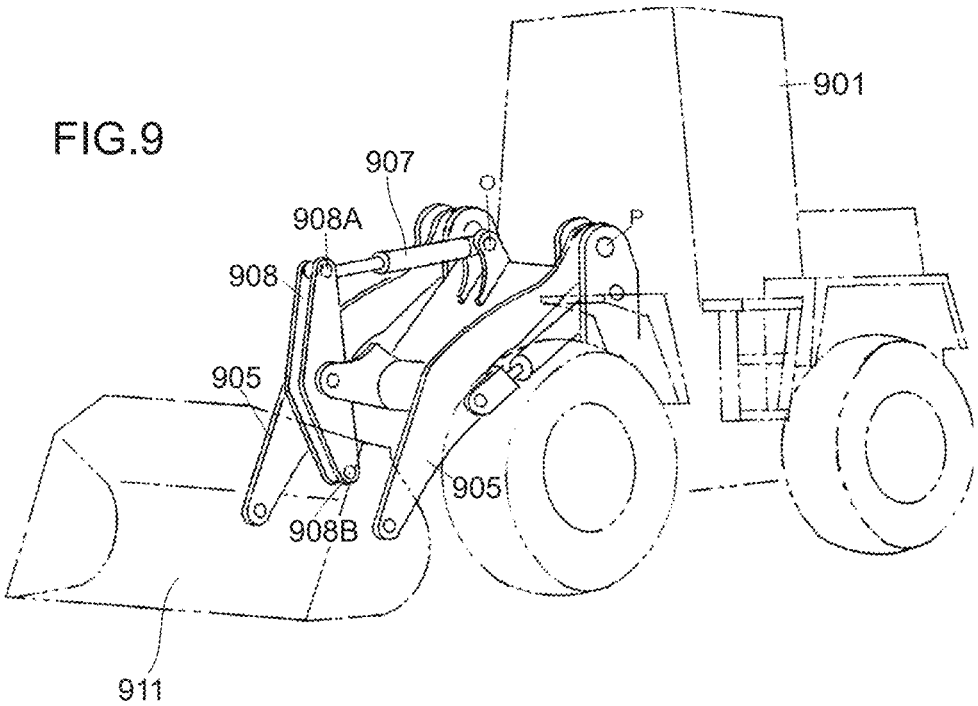
FIG. 9 is a view for describing a working vehicle 901 described in Japanese Laid-open patent publication No. 1999-343631.
Figure 10:
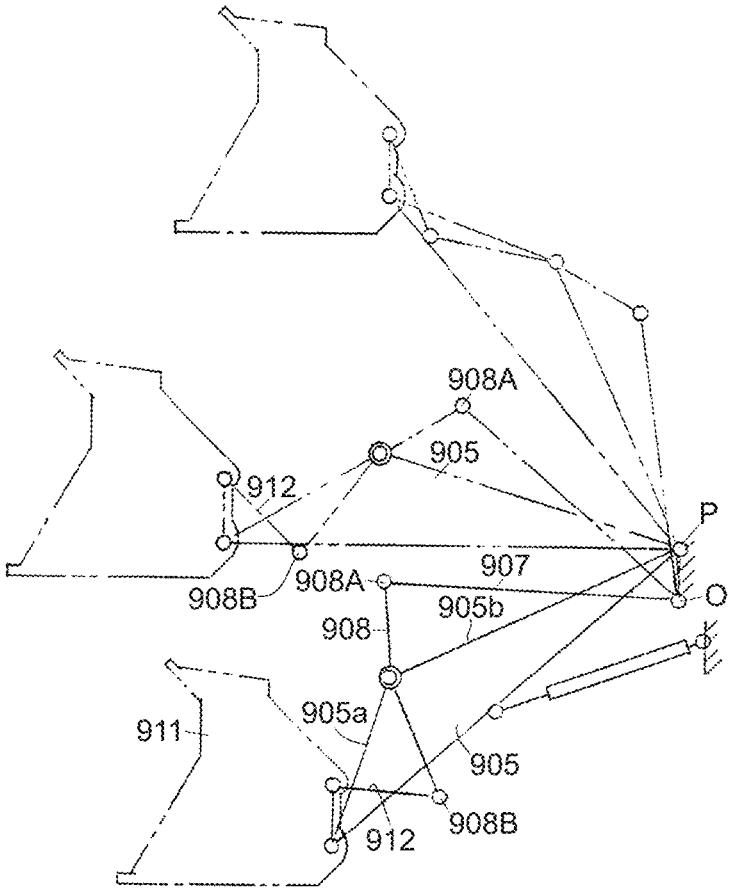
FIG. 10 is a view for describing a function that the working vehicle 901 described in Japanese Laid-open patent publication No. 1999-343631 has, that is, the function of elevating an arm while maintaining the angle of the bucket as it is.

FIG. 7 is a view for describing the movements of the arm 18 and the bucket 22 in the operation control system 3 of the working vehicle 10 according to the embodiment 3. FIG. 8 is a flowchart illustrating processing in the operation control system 3 of the working vehicle 10 according to the embodiment 3.

The control of the arm 18 and the bucket 22 in an arm height limit control system is described with reference to FIG. 7 and FIG. 8.

In the operation control system 3 of the working vehicle 10, the memory unit 32 stores the angle of the arm 18 at the stop position at which the arm 18 is stopped as the third angle information. During a period that the arm 18 is elevated by the operation of the operator, the control unit 30 compares the angle of the arm 18 that the third angle sensor 46 outputs and the value of the angle stored in the memory unit 32 as the third angle information to each other. The control unit 30 stops an operation of elevating the arm 18 when the angle of the arm 19 that the third angle sensor 46 outputs becomes the same value as the value of the angle of the third angle information stored in the memory unit 32.

In step S41, the angle of the arm 18 at the stop position is stored in the memory unit 32 (see FIG. 3) as the third angle information. In such processing, the stop position is the position at which the arm 18 is stopped by the arm height limit control system. For example, in FIG. 7, the position of the arm 18 and the position of the bucket 22 are indicated by a solid line.

As a method of storing the angle of the arm 18 at the stop position, a method is exemplified where the operator operates the arm 18 and the bucket 22 so as to move the arm 18 and the bucket 22 to the stop position. Then, the control unit 30 acquires the angle of the arm 18 by the third angle sensor 46 and makes the memory unit 32 store the angle of the arm 18.

Alternatively, the working vehicle 10 may include an input unit (not illustrated in the drawing), and the operator may input the angle of the arm 18 at the stop position via an input unit.

In step S42, the operator operates the arm 18. The operation of the arm 18 is the usual operation of the arm 18. That is, the operator can elevate or lower the arm 18 in a working using the working vehicle 10. A speed of the arm 18, when the arm 18 is elevated, is a first speed. The operator may perform an operation of changing an angle of the bucket 22 in addition to the operation of the arm 18.

In step S43, the control unit 30 acquires the angle of the arm 18 that the third angle sensor 46 outputs, and compares the acquired angle of the arm 18 with the value of the angle stored in the memory unit 32 as the third angle information. In a case where the difference between the current angle of the arm 18 and the value of the angle stored in the memory unit 32 as the third angle information is larger than a predetermined angle ("No" in S43), the processing returns to step S42. The operator can continue the operation of the arm 18.

In a case where the difference between the current angle of the arm 18 and the value of the angle stored in the memory unit 32 as the third angle information is not more than a predetermined angle ("Yes" in S43), the processing advances to step S44. The control unit 30 limits the elevation speed of the arm 18 to a slow speed. To be more specific, the control unit 30 limits the elevation speed of the arm 18 to the second speed slower than the first speed by decreasing a supply oil amount of a pressurized oil supplied to the arm cylinder 19. At the same time, an alarm notifying that the height of the arm is close to a height limit value may be displayed on a display unit not illustrated in the drawing that is provided to the cabin.

In step S45, the control unit 30 acquires the angle of the arm 18 that the third angle sensor 46 outputs, and compares acquired angle of the arm 18 with the value of the angle stored in the memory unit 32 as the third angle information. In a case where the difference between the current angle of the arm 18 and the value of the angle stored in the memory unit 32 as the third angle information is larger than 0° ("No" in S45), the processing returns to step S42. The operator continues the operation of the arm 18.

In a case where the difference between the current angle of the arm 18 and the value of the angle stored in the memory unit 32 as the third angle information is not more than 0° ("Yes" in S45), the processing advances to step S46. The control unit 30 stops an operation of elevating the arm 18. To be more specific, the supply of a pressurized oil to the arm cylinder 19 is stopped.

In the operation control system 3 (a height limit control system) of the working vehicle 10 according to the third embodiment, the angle that the third angle sensor 46 disposed on the arm 18 outputs and the value of the angle stored in the memory unit 32 as the third angle information are compared to each other, and when the angle that the third angle sensor 46 outputs and the value of the angle stored in the memory unit 32 as the third angle information become the same value, the control unit 30 stops the operation of elevating the arm 18.

With such a configuration, in a case where the working vehicle 10 is used in a place where a height limit is set such as an indoor or a place where an obstacle exists, it is possible to prevent the arm 18 from impinging on the obstacle disposed above the arm 18.

Further, according to the preferred embodiment of the operation control system 3 (the height limit control system) of the working vehicle 10 according to the third embodiment, when the difference between the angle that the third angle sensor 46 outputs and the value of the angle stored in the memory unit 32 as the third angle information becomes not more than a predetermined angle, the elevation speed of the arm is set to the second speed smaller than the first speed.

Accordingly, it is possible to prevent the arm 18 from impinging on an obstacle above the arm 18 more effectively.

Further, with respect to the operation control system 3 of the working vehicle 10 according to the third embodiment described above, the description is made with respect to the case where the operation of elevating the arm 18 is stopped by referencing the angle of the arm 18 that the third angle sensor 46 outputs. However, the operation control system 3 may be configured such that the operation of elevating the arm 18 is stopped by also using an angle of the bucket 22 that the first angle sensor 42 disposed on the bucket 22 outputs in addition to the angle of the arm 18.

The present invention is not limited to the above-mentioned embodiment, and various modifications are conceivable without departing from the gist of the present invention.

What is claimed is:

1. An operation control system of a working vehicle, comprising:

an arm;

a bucket mounted on the arm;

a controller;

a memory;

a first angle sensor configured to repeatedly measure a plurality of angles of the bucket; and a third angle sensor configured to repeatedly measure a plurality of angles of the arm, wherein the memory is configured to store a bucket reference angle at a target position of the bucket as first angle information and an arm reference angle at a target position of the arm as third angle information, and controller is configured to:

move, while repeatedly comparing the arm reference angle stored as the third angle information with each of the plurality of angles of the arm, the arm until the arm reference angle matches a corresponding one of the plurality of angles of the arm; and move, while repeatedly comparing the bucket reference angle stored as the first angle information with each of the plurality of angles of the bucket, the bucket until the bucket reference angle matches a corresponding one of the plurality of angles of the bucket.

2. The operation control system of a working vehicle according to claim 1, wherein the controller is further configured to perform a rollback operation of the bucket in parallel to a lowering operation of the arm when a current angle of the plurality of angles of the bucket is smaller than the bucket reference angle stored as the first angle information in the memory, and the lowering operation is to downwardly move the arm.

* * * * *